US007055585B2

(12) United States Patent
Higashiyama

(10) Patent No.: US 7,055,585 B2
(45) Date of Patent: Jun. 6, 2006

(54) LAYERED EVAPORATOR FOR USE IN MOTOR VEHICLE AIR CONDITIONERS OR THE LIKE, LAYERED HEAT EXCHANGER FOR PROVIDING THE EVAPORATOR, AND REFRIGERATION CYCLE SYSTEM COMPRISING THE EVAPORATOR

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 11/165,040

(22) Filed: Jun. 24, 2005

(65) Prior Publication Data

US 2005/0236148 A1 Oct. 27, 2005

Related U.S. Application Data

(63) Continuation of application No. 10/480,649, filed as application No. PCT/JP02/06376 on Jun. 26, 2002, now Pat. No. 6,923,251.

(60) Provisional application No. 60/304,764, filed on Jul. 13, 2001.

(30) Foreign Application Priority Data

Jun. 27, 2001 (JP) ..... 2001-194427

(51) Int. Cl.
*F28D 7/16* (2006.01)

(52) U.S. Cl. ..... 165/153; 165/174

(58) Field of Classification Search ..... 165/152, 165/153, 174, 176

See application file for complete search history.

(56) References Cited

U.S. PATENT DOCUMENTS 5,875,834 A 3/1999 Brooks
6,070,428 A 6/2000 Higashiyama et al.

(Continued)

FOREIGN PATENT DOCUMENTS

JP 8-178581 7/1996

(Continued)

*Primary Examiner*—Teresa J. Walberg
(74) *Attorney, Agent, or Firm*—Oblon, Spivak, McClelland, Maier & Neustadt, P.C.

(57) ABSTRACT

The invention relates to layered evaporators for use in motor vehicle air conditioners or the like, layered heat exchangers for providing such evaporators, and refrigeration cycle systems comprising the evaporator. At a specified intermediate portion of the heat exchanger with respect to the direction of juxtaposition of intermediate plates, a flat metal plate is interposed between one pair of intermediate metal plates providing a flat tube portion, or between two adjacent flat tube portions. The flat metal plate has a partition portion for blocking the passage of a fluid, a fluid passing hole for permitting passage of the fluid and an uneven flow preventing guide protuberance at an edge portion around the fluid passing hole.

The flat plate of very simple structure is used according to the invention as the plate having a partition for providing heat exchanger core passes. This permits use of a simlified plate die of low cost and makes it possible to provide a fluid circuit core having varying pass patterns, and made from a reduced number of components by a simplified assembling procedure which can be automated. The flat plate used further makes it possible to intentionally control the flow of fluid to preclude the occurrence of an uneven flow in the pass and to achieve improved perforamce. The concentration of stress due to the internal pressure of the fluid at the location where the fluid flow is turned is attenuated to give increased pressure resistance to the turn portion and to effectively prevent the break of tank side wall. The heat exchanger is made from metal plates of reduced thickness for a cost reduction and an improvement in heat exchange efficiency.

12 Claims, 12 Drawing Sheets

U.S. PATENT DOCUMENTS

| | | | |
|---|---|---|---|
| 6,272,881 | B1 | 8/2001 | Kuroyanagi et al. |
| 6,607,026 | B1 | 8/2003 | Naji et al. |

FOREIGN PATENT DOCUMENTS

| | | |
|---|---|---|
| JP | 2000-193392 | 7/2000 |
| JP | 2000-213888 | 8/2000 |

LAYERED EVAPORATOR FOR USE IN MOTOR VEHICLE AIR CONDITIONERS OR THE LIKE, LAYERED HEAT EXCHANGER FOR PROVIDING THE EVAPORATOR, AND REFRIGERATION CYCLE SYSTEM COMPRISING THE EVAPORATOR

CROSS REFERENCE TO RELATED APPLICATIONS

This application is an application filed under 35 U.S.C. 111(a) claiming the benefit pursuant to 35 U.S.C. 119(e)(1) of the filing data of Provisional Application No. 60/304,764 filed Jul. 13, 2001 pursuant to 35 U.S.C. 111(b).

TECHNICAL FIELD

The present invention relates to layered evaporators for use in motor vehicle air conditioners or the like, layered heat exchangers for providing such evaporators, and refrigeration cycle systems comprising the evaporator.

BACKGROUND OF THE INVENTION

It is usual practice to provide layered evaporators for use in motor vehicle air conditioners by fabricating a refrigerant circuit with use of at least two kinds of formed metal plates.

For example, two kinds of formed plates used for conventional layered evaporators are intermediate plates having a refrigerant channel recess and upper and lower header recesses greater than the channel recess in depth and each provided with a refrigerant hole formed in the bottom wall of the header recess, and a partition intermediate plate having a refrigerant channel recess and upper and lower header recesses which have a greater depth than the channel recess and one of which has a refrigerant hole formed in its bottom wall, the bottom wall of the other header recess having no hole and serving as a partition. Each of pairs of adjacent intermediate plates having refrigerant holes are fitted to each other in juxtaposed layers with the recessed sides thereof opposed to each other to provide flat tube portions arranged in parallel, and upper and lower headers in communication with the flat tube portions. At an intermediate portion of the evaporator with respect to the direction of juxtaposition of the plates, the intermediate plate having the partition in the header recess is used as one of the intermediate plates for providing the flat tube portion, whereby the core of the heat exchanger is divided into a plurality of pass units (groups of flat tube portions, hereinafter referred to as "passes"). The refrigerant flows through the entire heat exchanger core in a U-shaped pattern or zigzag through a refrigerant circuit having at least one turn.

When the evaporator comprises at least two kinds of formed plates like the conventional layered evaporator, there is a need to use at least two kinds of plate forming dies. The formed intermediate plate having a conventional partition has a cuplike portion (header recess) which greatly differs from like portions of the other intermediate plate, hence the need for a specific die and an increased die cost. Another problem is also encountered in that an increase in the number of components makes the heat exchanger core complex to assemble and difficult to fabricate by an automated process.

With the conventional layered evaporator, the heat exchanger core is divided into a plurality of passes by the intermediate plate having a partition, while the core is adapted to permit the refrigerant to flow uniformly through the tubes therein (flat tube portions) to achieve a higher efficiency. In actuality, however, it is difficult to intentionally control the flow of refrigerant when the fluid flows from one pass to the next pass, and there arises the problem that an uneven flow is likely to occur within the pass.

An object of the present invention is to overcome the foregoing problems of the prior art and to provide a layered heat exchanger with use of a flat plate of very simple structure as the plate having a partition for providing heat exchanger core passes, the flat plate being available with use of a simplified plate die at a low cost and makes it possible to provide a fluid circuit core having varying pass patterns, made from a reduced number of components by a simplified assembling procedure which can be automated, the flat plate used further makes it possible to intentionally control the flow of fluid when the fluid flows from one pass to the next pass while permitting the fluid to flow in uniformly divided streams free of the occurrence of an uneven flow in the pass to thereby give a uniform temperature distribution to the air discharged from the core to achieve improved performance. The invention also intends to provide a layered evaporator with a high evaporation efficiency for use in motor vehicle air conditioners, and a refrigeration cycle system comprising the evaporator and exhibiting outstanding air cooling performance.

DISCLOSURE OF THE INVENTION

The present invention provides a layered heat exchanger comprising a multiplicity of generally rectangular intermediate metal plates each having at least one channel recess formed on one side thereof and at least one pair of upper and lower header recesses communicating with respective upper and lower ends of the channel recess and having a greater depth than the channel recess, each of the upper and lower header recesses having a fluid hole formed in a bottom wall thereof, each of the intermediate plates being fitted to the intermediate plate immediately adjacent thereto in juxtaposed layers with the recessed sides thereof opposed to each other, the pair of adjacent intermediate layers being joined to each other at peripheral edges thereof to thereby form at least one flat tube portion and at least one pair of upper and lower header portions communicating with the flat tube portion so that the heat exchanger has a multiplicity of flat tube portions and many upper and lower header portions arranged in parallel, the heat exchanger being characterized in that a flat metal plate is interposed between one pair of intermediate metal plates providing the flat tube portion at a specified intermediate portion of the heat exchanger with respect to the direction of juxtaposition of the intermediate plates, the flat metal plate having a partition portion for blocking the passage of a fluid through the specified one of the upper and lower header portions communicating with the flat tube portion provided by said one pair of intermediate plates and a fluid passing hole for permitting passage of the fluid through the other header portion, a fluid channel being formed in the flat tube portion and the upper and lower header portions.

The present invention as defined in claim 2 provides a layered heat exchanger comprising a multiplicity of generally rectangular intermediate metal plates each having at least one channel recess formed on one side thereof and at least one pair of upper and lower header recesses communicating with respective upper and lower ends of the channel recess and having a greater depth than the channel recess, each of the upper and lower header recesses having a fluid hole formed in a bottom wall thereof, each of the intermediate plates being fitted to the intermediate plate immediately adjacent thereto in juxtaposed layers with the recessed sides thereof opposed to each other, the pair of adjacent intermediate layers being joined to each other at peripheral edges thereof to thereby form at least one flat tube portion and at least one pair of upper and lower header portions communicating with the flat tube portion so that the heat exchanger has a multiplicity of flat tube portions and many upper and lower header portions arranged in parallel, the heat exchange being characterized in that a flat metal plate is interposed between the two flat tube portions adjacent to each other at a specified intermediate portion of the heat exchanger with respect to the direction of juxtaposition of the intermediate plates, the flat metal plate having a partition portion for blocking the passage of a fluid between specified adjacent header portions among the upper and lower header portions communicating with said two adjacent flat tube portions and a fluid passing hole for permitting passage of the fluid between the other adjacent header portions, a fluid channel being formed in the flat tube portions and the upper and lower header portions.

According to the invention as defined in claim 1 and 2, an edge portion around the fluid passing hole formed in the flat metal plate is provided with a guide protuberance for diffusing the fluid flowing through the fluid passing hole into the header. Preferably, the guide protuberance serves to guide the fluid flowing through the fluid passing hole to the flat tube portion in the vicinity of the fluid passing hole.

Further according to the invention as defined in claim 1 and 2, it is desired that a fluid channel be formed in all the flat tube portions and the upper and lower header portions for the fluid to pass therethrough in a U-shaped pattern or zigzag.

Further according to the invention as defined in claim 2, a corrugated fin is interposed between each pair of adjacent flat tube portions, and the flat metal plate interposed between said two adjacent flat tube portions at the specified intermediate portion of the heat exchanger is provided on respective opposite sides thereof with a pair of divided corrugated fins having about one-half of the height of the corrugated fin.

For example when one channel recess is provided on one side of the intermediate plate of the heat exchanger described, one pair of upper and lower header recesses are formed in communication with the upper and lower ends of the channel recess.

On the other hand, when front and rear two channel recesses are provided on one side of the intermediate plate, with a central partition ridge provided therebetween, two pairs, i.e., an upper and a lower pair, of front and rear header recesses are provided in communication with the upper and lower ends of the channel recesses. The intermediate plate may be provided on one side thereof with three or more channel recesses. The upper and lower header recesses are then provided in pairs which are equal in number to the number of pairs of the channel recesses.

The flat plate having a partition portion is disposed between one pair of intermediate metal plates providing one flat tube portion at the specified intermediate portion of the exchanger (claim 1), or between two flat tube portions which are adjacent to each other (claim 2).

In either case, when the intermediate plate has on one side thereof a channel recess and a pair of upper and lower header recesses communicating respectively with the upper and lower ends thereof, the flat plate has a partition portion corresponding to one of the upper and lower header recesses of the intermediate plate, and a fluid passing hole for the other header recess. On the other hand, when the intermediate plate is provided on one side thereof with at least two channel recesses, with a partition ridge formed between the pair of adjacent channel recesses, and with upper and lower header recesses formed in pairs which are equal in number to the number of channel recesses and communicating with the upper and lower ends of the channel recesses, the flat plate has a partition portion corresponding to one of the upper and lower header recesses of the intermediate plate and refrigerant passing holes corresponding to the other header recesses.

The invention as defined in claim 7 provides a layered heat exchanger comprising a multiplicity of generally rectangular intermediate metal plates each having at least one channel recess formed on one side thereof and at least one pair of upper and lower header recesses communicating with respective upper and lower ends of the channel recess and having a greater depth than the channel recess, each of the upper and lower header recesses having a fluid hole formed in a bottom wall thereof, each of the intermediate plates being fitted to the intermediate plate immediately adjacent thereto in juxtaposed layers with the recessed sides thereof opposed to each other, the pair of adjacent intermediate layers being joined to each other at peripheral edges thereof to thereby form at least one flat tube portion and at least one pair of upper and lower header portions communicating with the flat tube portion so that the heat exchanger has a multiplicity of flat tube portions and many upper and lower header portions arranged in parallel, an uneven flow preventing flat metal plate being interposed between one pair of intermediate metal plates providing the flat tube portion at a specified intermediate portion of the heat exchanger with respect to the direction of juxtaposition of the intermediate plates, the flat metal plate having fluid passing holes for permitting the passage of a fluid through the respective upper and lower header portions communicating with the flat tube portion provided by said one pair of intermediate plates and a guide protuberance formed at an edge portion around at least one of the fluid passing holes for diffusing the fluid flowing through the fluid passing hole into the header.

The invention as defined in claim 8 provides a layered heat exchanger comprising a multiplicity of generally rectangular intermediate metal plates each having at least one channel recess formed on one side thereof and at least one pair of upper and lower header recesses communicating with respective upper and lower ends of the channel recess and having a greater depth than the channel recess, each of the upper and lower header recesses having a fluid hole formed in a bottom wall thereof, each of the intermediate plates being fitted to the intermediate plate immediately adjacent thereto in juxtaposed layers with the recessed sides thereof opposed to each other, the pair of adjacent intermediate layers being joined to each other at peripheral edges thereof to thereby form at least one flat tube portion and at least one pair of upper and lower header portions communicating with the flat tube portion so that the heat exchanger has a multiplicity of flat tube portions and many upper and lower header portions arranged in parallel, an uneven flow preventing flat metal plate being interposed between the two flat tube portions adjacent to each other at a specified intermediate portion of the heat exchanger with respect to the direction of juxtaposition of the intermediate plates, the flat metal plate having fluid passing holes for permitting the passage of a fluid between the upper and lower header portions communicating with said two adjacent flat tube portions and a guide protuberance formed at an edge portion around at least one of the fluid passing holes for diffusing the fluid flowing through the fluid passing hole into the header.

Preferably, the guide protuberance defined in claim 7 or 8 is preferably one which serves to guide the fluid flowing through the fluid passing hole into the flat tube portion in the vicinity of the hole.

In the heat exchanger according to claim 8, a corrugated fin is interposed between each pair of adjacent flat tube portions, and the uneven flow preventing flat metal plate interposed between said two adjacent flat tube portions at the specified intermediate portion of the heat exchanger is provided on respective opposite sides thereof with a pair of divided corrugated fins having about one-half of the height of the corrugated fin.

The heat exchanger according to claim 7 or 8 may have as disposed at an intermediate location with respect to the direction of juxtaposition of intermediate layers, both the flat plate having a partition portion and the uneven flow preventing flat plate, or the uneven flow preventing flat plate only.

Any one of the layered heat exchangers described above provides a layered evaporator of the invention for use in motor vehicle air conditioners.

The refrigeration cycle system embodying the invention comprises the foregoing layered evaporator and serves as such for use in motor vehicle air conditioners.

The flat plate of very simple structure is used in the layered heat exchanger according to the invention defined in claim 1 as a plate having a partition for providing heat exchanger core passes. This permits use of a simplified plate die of low cost and makes it possible to provide a fluid circuit core having varying pass patterns, and made from a reduced number of components by a simplified assembling procedure which can be automated.

Further the heat exchanger of the invention has a flat metal plate which is provided with a guide protuberance at an edge portion around a fluid passing hole in the flat metal plate for diffusing the fluid flowing through the hole into the header. This results in advantages. When moving from one pass to the next pass, the flow of fluid can be intentionally controlled by the guide protuberance to thereby preclude the occurrence of an uneven flow within the pass, permitting the fluid to flow in uniformly divided streams and giving a uniform temperature distribution to the air discharged from the core to ensure improved performance.

The heat exchanger of the invention as defined in claim 7 has an uneven flow preventing flat metal plate interposed between one pair of intermediate metal plates providing the flat tube portion at a specified intermediate portion of the heat exchanger with respect to the direction of juxtaposition of the intermediate plates, and the flat metal plate has fluid passing holes for permitting the passage of a fluid through the respective upper and lower header portions communicating with the flat tube portion provided by said one pair of intermediate plates, and a guide protuberance formed at an edge portion around at least one of the fluid passing holes for diffusing the fluid flowing through the fluid passing hole into the header. Further the heat exchanger according to the invention as defined in claim 8 has an uneven flow preventing flat metal plate interposed between the two flat tube portions adjacent to each other at a specified intermediate portion of the heat exchanger with respect to the direction of juxtaposition of the intermediate plates, and the flat metal plate has fluid passing holes for permitting the passage of a fluid between the upper and lower header portions communicating with said two adjacent flat tube portions, and a guide protuberance formed at an edge portion around at least one of the fluid passing holes for diffusing the fluid flowing through the fluid passing hole into the header. In either case, the heat exchange has the advantages that when moving from one pass to the next pass, the flow of fluid can be intentionally controlled by the guide protuberance to thereby preclude the occurrence of an uneven flow within the pass, permitting the fluid to flow in uniformly divided streams and giving a uniform temperature distribution to the air discharged from the core to ensure improved performance.

The layered evaporator of the invention provided by the heat exchanger described above is outstanding in heat exchange performance, very high in refrigerant evaporation efficiency and diminished in pressure loss within the headers.

The refrigeration cycle system of the invention comprising the evaporator and adapted for use in motor vehicle air conditioners has the advantage of exhibiting outstanding air cooling performance.

BRIEF DESCRIPTION OF THE DRAWINGS

FIG. 5*b* being an enlarged side elevation partly broken away; FIG. 5*c* being an enlarged view in section taken along the line c—c in FIG. 5*a*.

FIG. 11*b* being an enlarged side elevation partly broken away; FIG. 11*c* being an enlarged view in section taken along the line c—c in FIG. 11*a*.

BEST MODE OF CARRYING OUT THE INVENTION

Embodiments of the invention will be described below with reference to the drawings.

Figure 1:
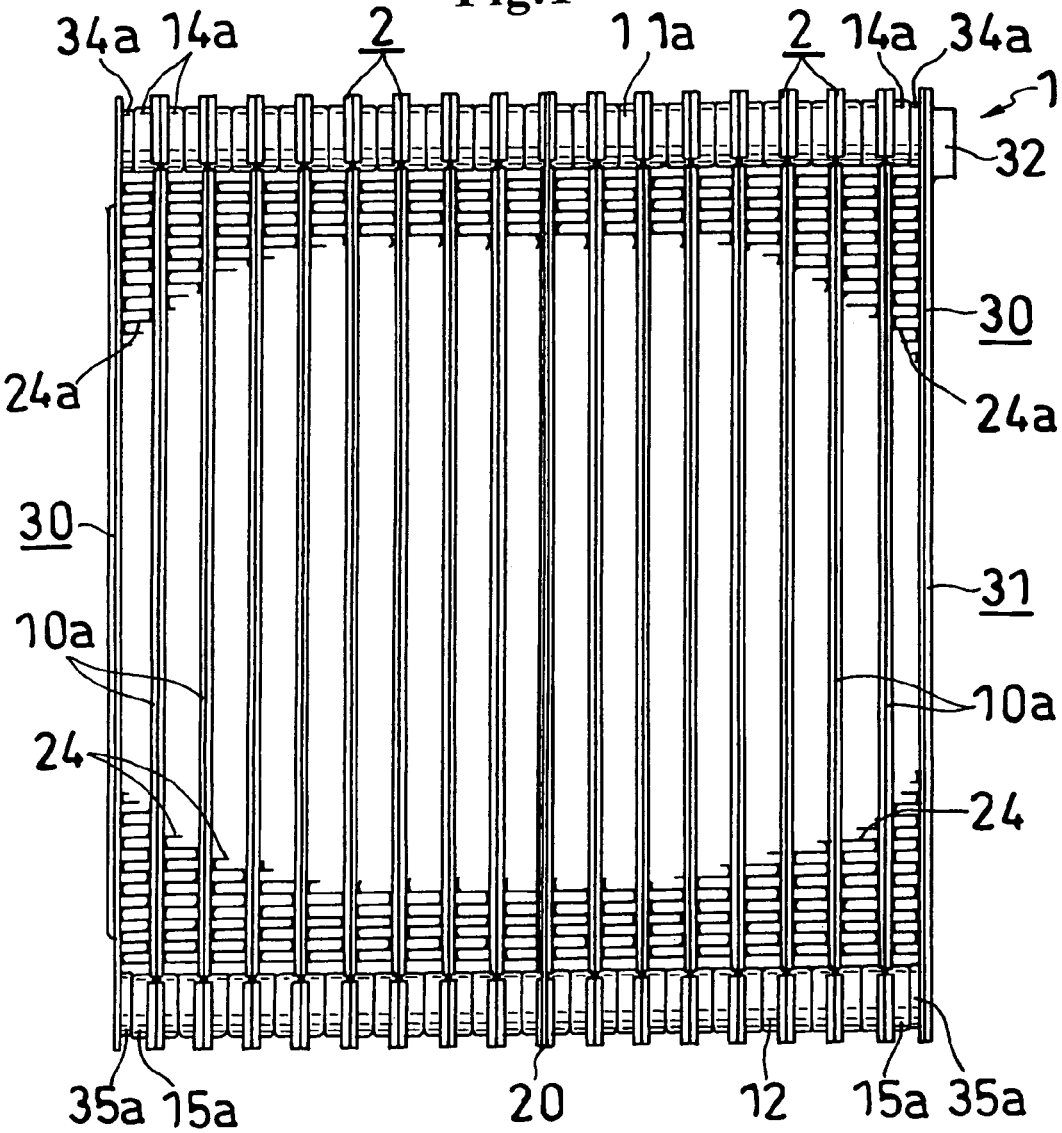
FIG. 1 is a front view schematically showing a layered heat exchanger of first embodiment of the invention.

The terms "left," "right," "front," "rear," "upper" and "lower" as used herein are based on FIG. 1; the term "left" refers to the left-hand side of FIG. 1, the term "right" to the right-hand side thereof, the term "front" to the front side of the plane of the drawing, the term "rear" to the rear side thereof, the term "upper" to the upper side of the drawing, and the term "lower" to the lower side thereof.

The drawings show the invention as embodied into layered evaporators for use in motor vehicle air conditioners.

FIGS. 1 to 6 show a first embodiment of layered evaporator of the invention. With reference to these drawings, the layered evaporator 1 is made from aluminum (including aluminum alloys) and comprises a multiplicity of rectangular intermediate plates 2 arranged side by side and elongated in vertical direction, and end plates 30, 30 arranged at left and right sides of the arrangement externally thereof and identical to the plates 2 in shape. The evaporator 1 is generally rectangular when seen from the front.

Each of the intermediate plate 2 has a pair of front and rear bulging portions 13*a*, 13*b* which are provided respectively with front and rear two refrigerant channel recesses 3*a*, 3*b* formed on one side of the plate 2 and separated by a vertically elongated partition-center ridge 6. The intermediate plate 2 further has an upper and a lower pair of front and rear cuplike protrusions 14*a*, 14*b*, 15*a*, 15*b* positioned respectively at the upper and lower ends thereof and having upper and lower two pairs of header recesses 4*a*, 4*b*, 5*a*, 5*b* which are in communication with the respective upper and lower ends of the channel recesses 3*a*, 3*b* and have a greater depth than these recesses 3*a*, 3*b*.

Each pair of adjacent intermediate plates 2, 2 are fitted to each other in juxtapose layers, with their recessed sides having the recesses 3*a*, 3*b*, 4*a*, 4*b*, 5*a*, 5*b* opposed to each other, and are joined to each other at their peripheral edges, to thereby form two front and rear flat tube portions 10*a*, 10*b* each having a flat channel, and an upper and a lower pair of front and rear header portions 11*a*, 11*b*, 12*a*, 12*b* communicating with the upper and lower ends of the flat tube portions 10*a*, 10*b*. A multiplicity of such pairs of intermediate plates are arranged in parallel.

The channel recesses 3*a*, 3*b* of each intermediate plate 2 providing the front and rear flat tube portions 10*a*, 10*b* are each provided with vertically elongated flow smoothing ridges 16 extending from the lower end of the recess 3*a* or 3*b* to a position close to the upper end thereof, whereby the interior of the flat tube portion 10*a* or 10*b* is divided into a plurality of refrigerant passageways.

At the upper and lower ends of the intermediate plate 2, generally circular refrigerant holes 8*a*, 8*b*, 9*a*, 9*b* are formed in the outer ends of the respective front and rear cuplike protrusions 14*a*, 14*b*, 15*a*, 15*b*, and the peripheral portion of the protrusion defining each of the refrigerant holes 8*a*, 8*b*, 9*a*, 9*b* has an outwardly projecting annular wall 19.

Figure 2:
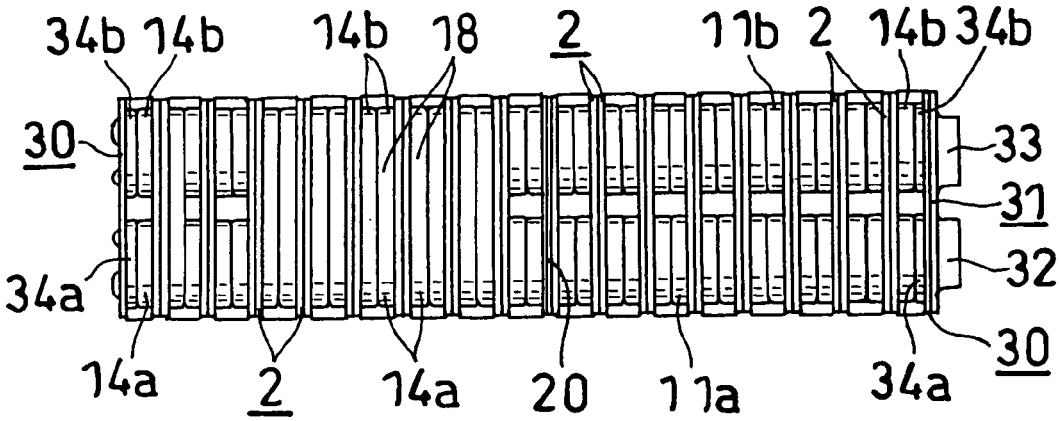
FIG. 2 is a schematic plan view.

The present embodiment has, for example, 16 pairs of intermediate plates 2 as shown in FIGS. 1 and 2. Interposed between the pair of intermediate plates 2, 2 positioned at the right of the midportion of the evaporator and providing flat tube portions 10*a*, 10*b* is a flat plate 20 which has a partition portions 21*a*, 21*b* for blocking the passage of refrigerant through the upper 11*a*, 11*b* of the upper and lower header portions 11*a*, 11*b*, 12*a*, 12*b* communicating with these flat tube portions 10*a*, 10*b*, and refrigerant passing holes 22*a*, 22*b* permitting the passage of the refrigerant through the other header portions, i.e., the lower header portions 12*a*, 12*b*. Thus, refrigerant channel are provided through which the refrigerant flows zigzag through the entire assembly of flat tube portions 10*a*, 10*b* and upper and lower header portions 11*a*, 11*b*, 12*a*, 12*b*.

Figure 3:
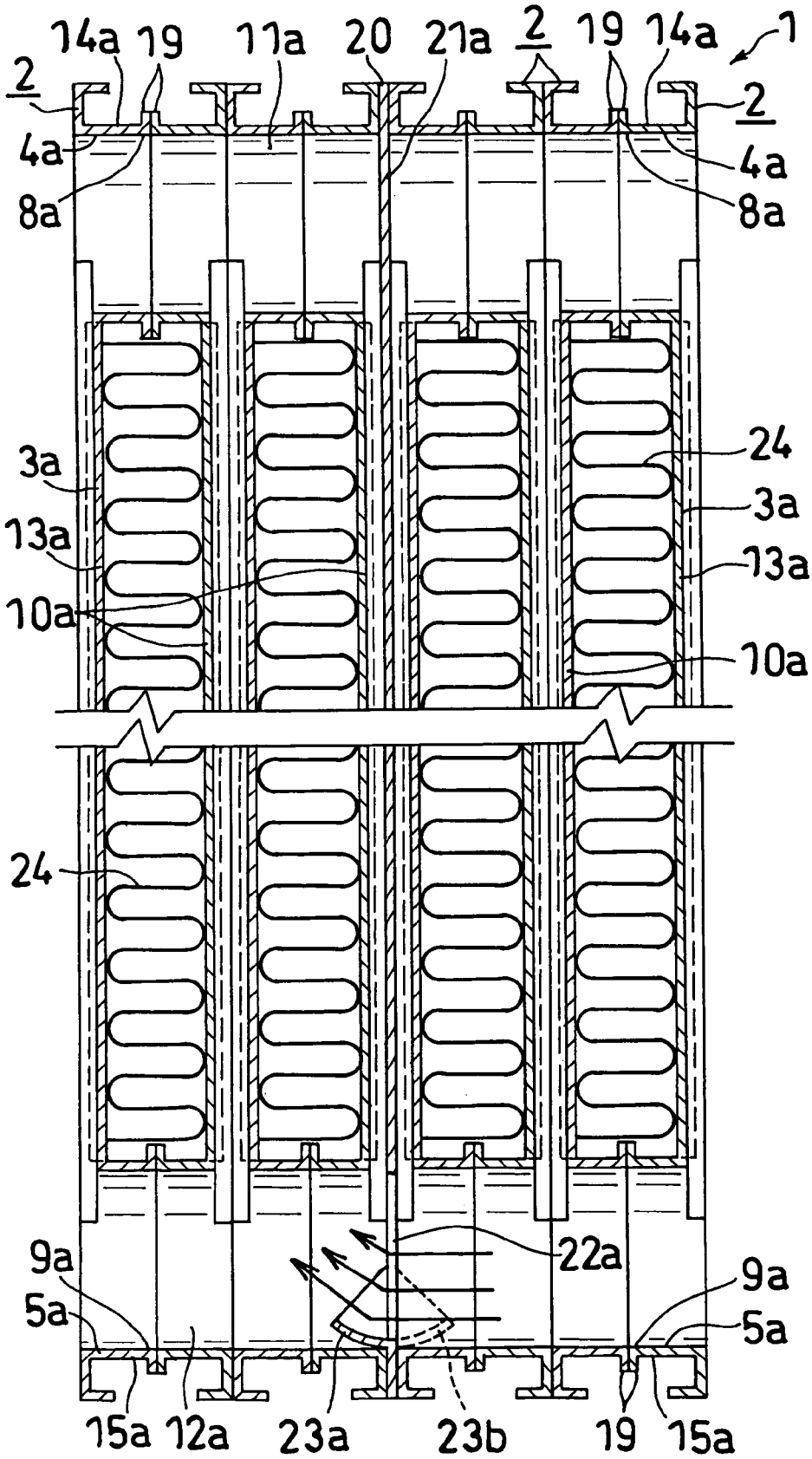
FIG. 3 is an enlarged fragmentary view in vertical section of the heat exchanger of FIG. 1.
Figure 4:
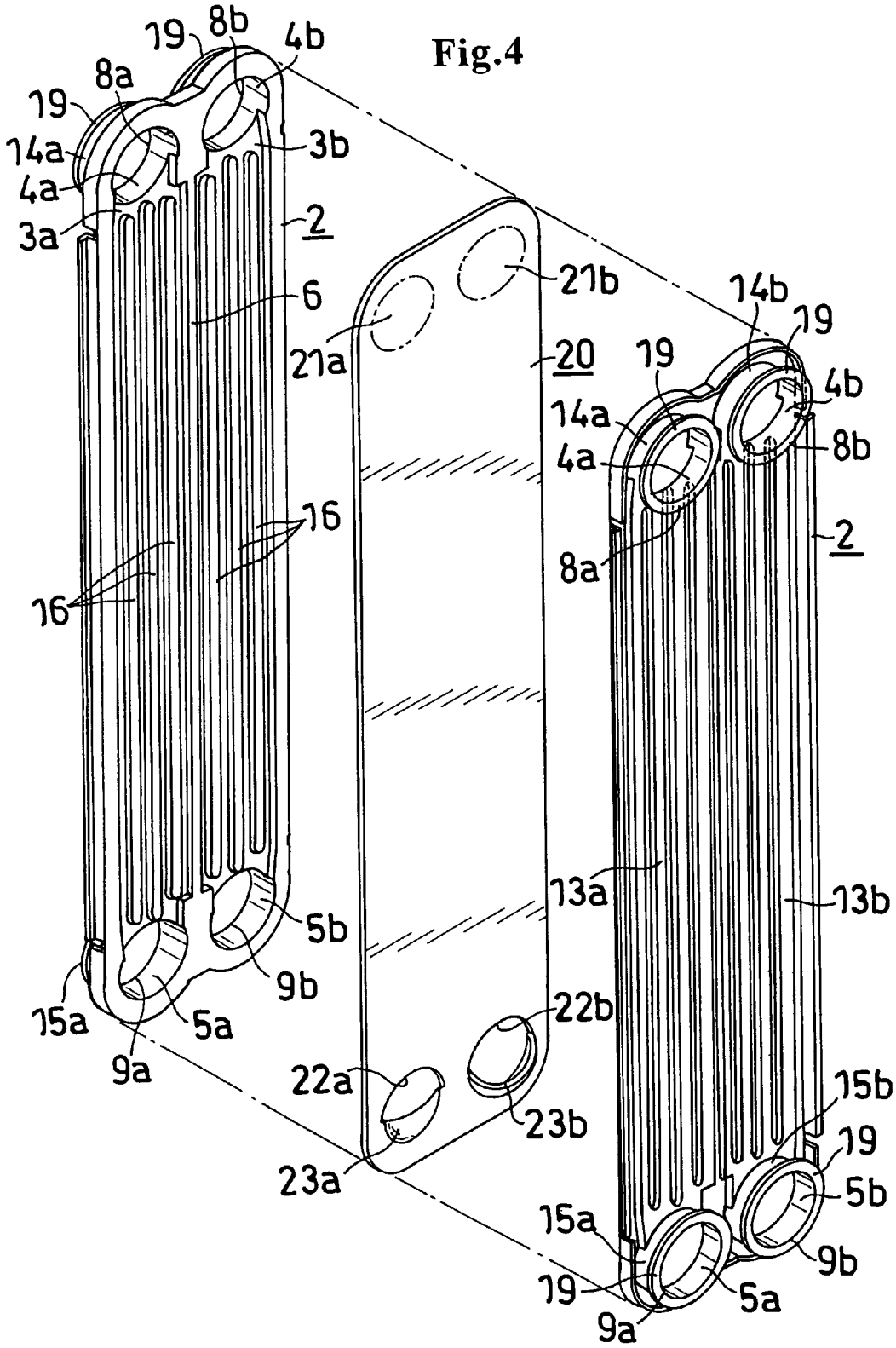
FIG. 4 is an enlarged exploded perspective view showing two intermediate metal plates and a flat metal plate constituting flat tube portions of the heat exchanger of FIG. 1.
Figure 5:
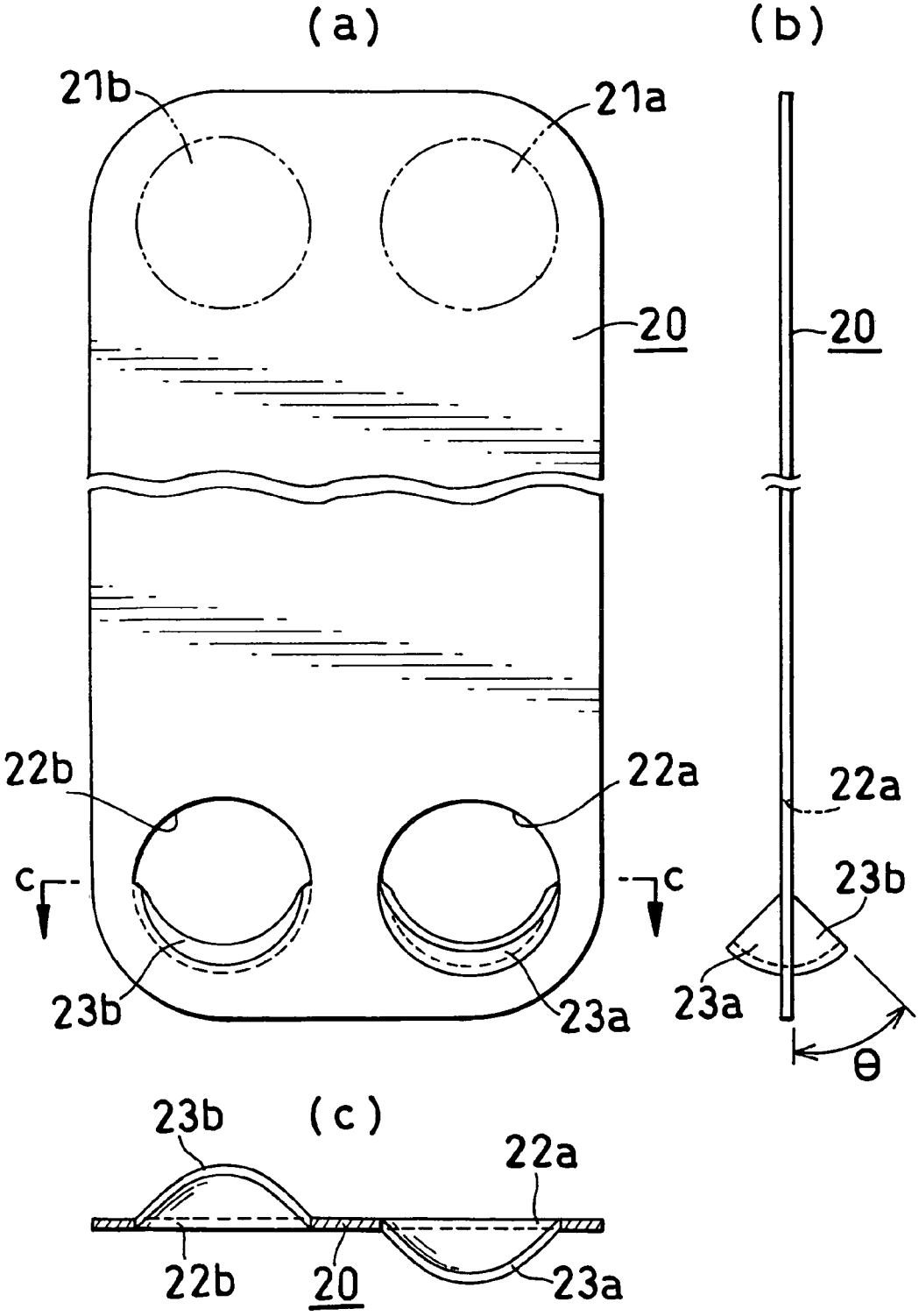
FIG. 5 shows the flat metal plate of FIG. 4, FIG. 5*a* being an enlarged front view partly broken away.

As shown in detail in FIGS. 3 to 5, an edge portion defining each of the refrigerant passing holes 22*a*, 22*b* formed in the flat plate 20 is provided with a guide protuberance 23*a* (23*b* ) for diffusing the refrigerant passing through the hole 22*a* or 22*b* into the lower header portion 12*a* or 12*b*.

The illustrated guide protuberances 23*a*, 23*b* are so shaped as to resemble a portion of a spherical surface. When seen from the front of the flat plate 20, the protuberance has an approximately circular-arc shape and is inclined leftwardly upward and rightwardly upward. Accordingly, the refrigerant passing through the refrigerant passing holes 22*a*, 22*b* formed in the flat plate 20 can be guided by these guide protuberances 23*a*, 23*b* into the flat tube portions 10*a*, 10*b* close to the holes 22*a*, 22*b*. When the refrigerant moves to the next pass (group of flat tube portions) after passing through the holes 22*a*, 22*b* in the flat plate 20, the guide protuberances 23*a*, 23*b* intentionally controls the flow of refrigerant, permitting the refrigerant to flow in uniformly divided streams to preclude generation of an uneven flow within the pass.

The guide protuberances 23*a*, 23*b* provided at the edges around the refrigerant passing holes 22*a*, 22*b* have an angle with the flat plate 20 as shown in FIG. 5*b* when seen from one side. In the illustrated case, =45 deg. The angle of the guide protuberance 23*a*, 23*b* with the flat plate 20 is 5 to 80 deg, preferably 10 to 70 deg, more preferably 15 to 60 deg, and most preferably 15 to 45 deg.

According to the present embodiment, the guide protuberance 23*a*, 23*b* are provided in the lower header portions 12*a*, 12*b* and are therefore inclined leftwardly upward and rightwardly upward, whereas if provided, for example, in the upper header portions 11*a*, 11*b*, these guide protuberances 23*a*, 23*b* are inclined leftwardly downward or rightwardly downward. The guide protuberances 23*a*, 23*b* are not limited to those illustrated in shape and angle of inclination but can be modified variously.

With reference to FIGS. 1 and 2, corrugated fins 24, 24 are interposed between the flat tube portions 10*a*, 10*b* which are adjacent to each other laterally, and corrugated fins 24*a*, 24*a* of lower height are provided between each of the left and right end plates 30, 30 and the flat tube portions 10*a*, 10*b* adjacent thereto. Cuplike protrusions 34*a*, 34*b*, 35*a*, 35*b* of the left and right end plates 30, 30 have a smaller height than the pairs of front and rear cuplike protrusions 14*a*, 14*b*, 15*a*, 15*b* having upper and lower header recesses 4*a*, 4*b*, 5*a*, 5*b* of each intermediate plate 2 to diminish the clearance between each end plate 30 and the intermediate plate 2 immediately adjacent thereto.

Further disposed on the outer side of the right end plate 30 is a side plate 31 having a refrigerant inlet 32 and a refrigerant outlet 33 in its upper end.

Among the components of the layered evaporator 1 described, the intermediate plates 2, flat plate 20 having the partition portions 21*a*, 21*b* and left and right end plates 30, 30 are each made from an aluminum brazing sheet. The corrugated fins 24, 24*a* and side plate 31 are made of aluminum.

All the components of the evaporator 1 as assembled are collectively brazed, for example, by the vacuum brazing process to fabricate the evaporator 1.

Figure 6:
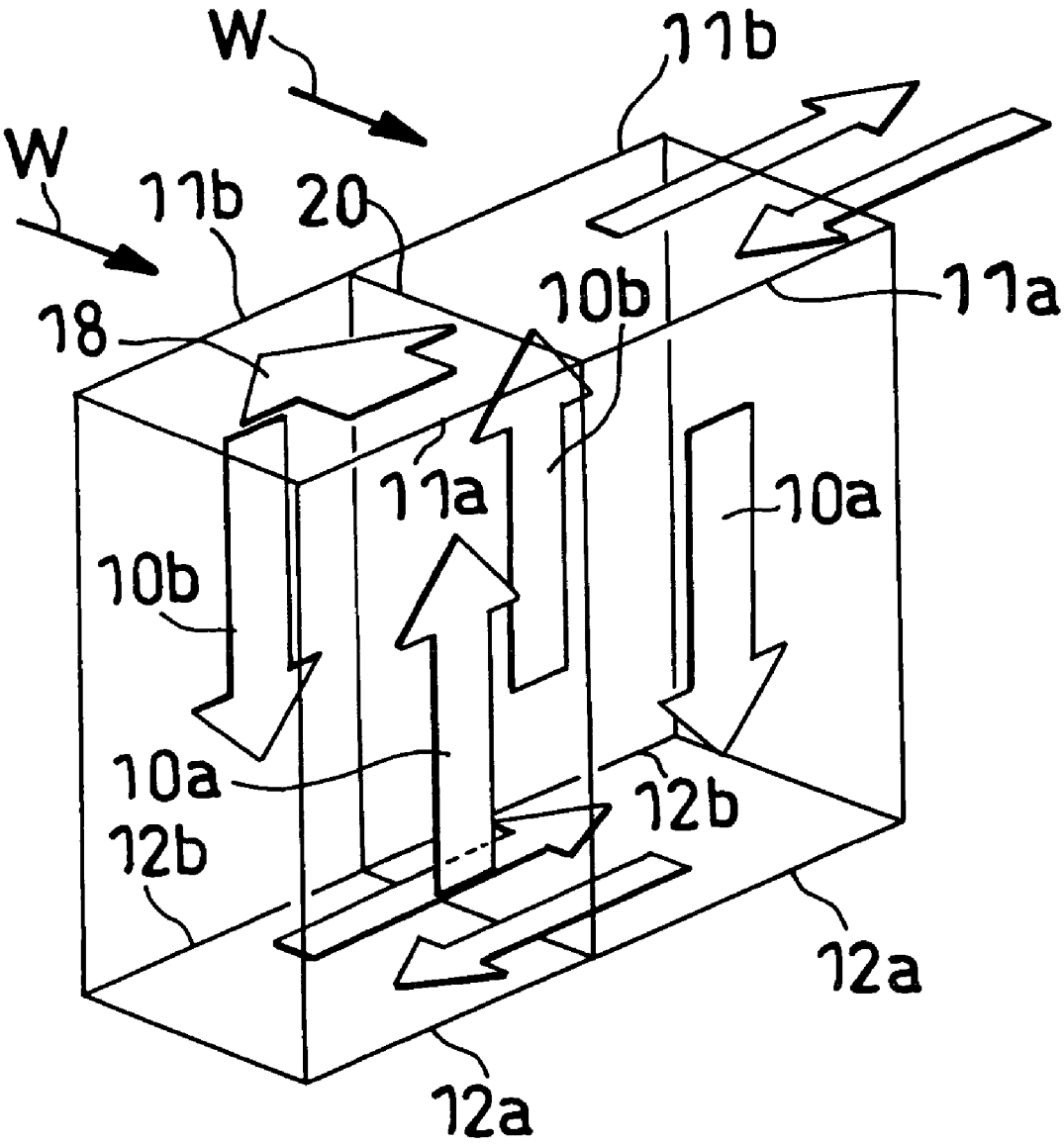
FIG. 6 is a perspective view for schematically illustrating the refrigerant channels of the heat exchanger of FIG. 1.

With reference to FIGS. 1, 2 and 6 showing the layered evaporator 1, the refrigerant flows into the right end of the front upper header 11*a* from the inlet 32 in the right side plate 31 through a refrigerant hole (not shown) in the end plate 30. The refrigerant then flows through the right half of the front upper header 11*a* until the fluid strikes on the partition portion 21*a* of the flat plate 20 at the midportion of the evaporator 1 with respect to the juxtaposition of layers of intermediate plates while flowing down the front flat tube portions 10*a* in communication with the front upper header 11*a* to reach the right half of the front lower header 12*a*.

The refrigerant then flows through the generally circular refrigerant passing hole 22*a* formed in the lower-end front portion of the flat plate 20 at the midportion of the evaporator 1 into the left half of the front lower header 12*a*. Since the edge portion around the hole 22*a* is provided with the guide protuberance 23*a*, the refrigerant passing through the hole 22*a* can be diffused into the front lower header 12*a*, and especially in the case of the present embodiment, the fluid can also be guided into the front flat tube portions 10*a* which are close to the hole 22*a*. In this way, the guide protuberance 23*a* provided intentionally controls the flow of the refrigerant, causing the refrigerant to flow in uniformly divided streams to preclude occurrence of anuneven flow in the pass.

The refrigerant further flows through the left half of the front lower header 12*a* until striking on the partitioning portion of the end plate 30 and flows up the front flat tube portions 10*a* communicating with the left half of the front lower header 12*a* to reach the left half of the front upper header 11*a*.

In the left half of the evaporator 1, the upper header recesses 4*a*, 4*b* of each intermediate plate 2 communicate with each other through a communication passageway 18, so that the refrigerant flows from the left half of the front upper header 10*a* to the left half of the rear upper header 11*b* through communication passageways 18.

The refrigerant then flows down the rear flat tube portions 10*b* communicating with the rear upper header 11*b* and reaches the left half of the rear lower header 12*b*.

Since the flat plate 20 in the midportion of the evaporator 1 has the substantially circular refrigerant passing hole 22*b* in its lower-end rear portion, the refrigerant flows through this hole 22*b* and flows into the right half of the rear lower header 12*b*. With the edge portion around the hole 22*b* provided with the guide protuberance 23*b*, the refrigerant passing through the hole 22*b* can be diffused into the rear lower header 12*b* , and especially in the case of the present embodiment, the fluid can also be guided into the rear flat tube portions 10*b* which are close to the hole 22*b*. In this way, the guide protuberance 23*b* provided intentionally controls the flow of the refrigerant, causing the refrigerant to flow in uniformly divided streams to preclude occurrence of an uneven flow in the pass.

The refrigerant further flows through the right half of the rear lower header 12*b* until striking on the partitioning portion of the right end plate 30 and flows up the rear flat tube portions 10*b* communicating with the right half of the rear lower header 12*b* to reach the right half of the rear upper header 11*b*. Finally the refrigerant is discharged to the outside from the refrigerant outlet 33 in the right side plate 31 via refrigerant hole (not shown) in the right end plate 30.

On the other hand, an air stream (air) W flows from behind the evaporator 1 toward the front through the clearances in the corrugated fins 24 between the adjacent flat tube portions 10*a*, 10*b* of the evaporator 1 and in the corrugated fins 24*a* between each end plate 30 and the flat tube portions 10*a*, 10*b* adjacent thereto, subjecting the refrigerant to efficient heat exchange with the air through the walls of the intermediate plates 2 and the corrugated fins 24*a*.

The flat plate 20 of very simple structure is used in the evaporator 1 described as a plate having partition portions required for providing core passes. This simplifies the die for the plate, hence a reduced die cost. Furthermore, provision of the flat plate 20 having the partition portions 21*a*, 21*b* makes it possible to form refrigeration circuit cores having various types of passes. The layered evaporator 1 can be fabricated with a reduced number of components, which are easy to assemble to ensure a high work efficiency and to shorten the period of time required for the fabrication of the evaporator 1. The evaporator can therefore be manufactured with an improved efficiency by an automated process.

After the evaporator 1 has been fabricated, the location where the flat plate 20 having the partition portions 21*a*, 21*b* is installed can be recognized visually from outside the evaporator 1 to check whether the evaporator 1 has the specified refrigerant circuit. This serves to preclude production of faulty evaporators.

The location where the flat plate 20 is installed in the evaporator 1 is not limited to the central portion of the core of the evaporator 1, but the plate can be positioned as suitably shifted leftward or rightward in view of the heat exchange performance.

The flat plate 20 having the partition portions 21*a*, 21*b* and to be installed may be at least one in number. In the case where the evaporator has only one flat plate 20, the refrigerant circuit is U-shaped in its entirety.

With the illustrated evaporator 1, the intermediate plate 2 has on one side thereof front and rear two channel recesses 3*a*, 3*b* with a partitioning ridge 6 provided therebetween centrally of the plate, and an upper and a lower pair of front and rear header recesses 4*a*, 4*b*, 5*a*, 5*b* communicating with the respective upper and lower ends of these recesses 3*a*, 3*b*, but the plate 2 is not limited to this structure. For example, the intermediate plate 2 may have one channel recess 3 on one side thereof. In this case, a pair of upper and lower header recesses 4, 5 are formed in communication with the respective upper and lower ends of the recess 3.

The intermediate plate 2 may be provided on one side thereof with three or more channel recesses 3, with a partition ridge 6 formed between each pair of adjacent channel recesses 3. The plate 2 then has upper and lower header recesses 4, 5 in pairs which are equal in number to the number of channel recesses 3.

In the case where the intermediate plate 2 has on one side thereof one channel recess 3 and one pair of upper and lower header recesses 4, 5 in communication with the respective upper and lower ends of the recess 3, the flat plate 20 is provided with a partition portion 21 corresponding to one of the upper and lower header recesses 4, 5 of the plate 2, and a refrigerant passing hole 22 corresponding to the other header recess 4 or 5.

On the other hand, when the intermediate plate 2 is provided on one side thereof with at least two channel recesses 3, with a partition ridge 6 formed between the pair of adjacent channel recesses 3, and with upper and lower header recesses 4, 5 formed in pairs which are equal in number to the number of channel recesses 3 and communicating with the upper and lower ends of the channel recesses, the flat plate 20 has a partition portion 21 corresponding to one of the upper and lower header recesses 4, 5 of the intermediate plate 2 and refrigerant passing holes 22 corresponding to the other header recesses 4, 5.

The corrugated fins 24*a*, 24*a* having a smaller height than those 24, 24 between the adjacent flat tube portions 10*a*, 10*a* are provided between each of the left and right end plates 30, 30 and the flat tube portion 10*a*, 10*b* adjacent thereto, this is intended to give a uniform temperature distribution to the air discharged through the core of the evaporator 1.

Conventionally, the corrugated fins (main fins) 24, 24 between the adjacent flat tube portions 10*a*, 10*a* and the corrugated fins (side fins) 24*a*, 24*a* between each of the end plates 30, 30 and the flat tube portions 10*a*, 10*a* adjacent thereto have the same height. In this case, the main fins 24 in the core are supplied with heat from the flat tube portions at the left and right sides thereof, whereas the side fins 24*a*, 24*a* are given heat from the flat tube portions on only one side thereof, so that there occurs a difference in temperature between the air discharged through the main fins 24 and the air discharged through the side fins 24*a*.

Accordingly, the side fins 24*a* are given a smaller height than the main fins 24 to give the side fins 24*a* a higher fin efficiency. Since a greater amount of air tends to flow through the main fins 24 because of an increased resistance to the flow of air through the side fins 24, air flows through the side fins 24*a* at a reduced rate. This minimizes the differences in the temperature distribution of the air discharged through the entire core of the evaporator 1 to give a uniform temperature distribution to the air discharged through the core.

Although not shown, the motor vehicle air conditioner comprises a refrigeration cycle including a compressor, condenser and expansion valve in addition to the evaporator 1 described.

A fundamental experiment was conducted using the layered evaporator 1 of first embodiment shown in FIGS. 1 to 6 to check the performance of the evaporator 1 when varying angles were given to the guide protuberances 23*a*, 23*b* provided at the edge along the refrigerant passing holes 22*a*, 22*b* of the flat plate 20.

The evaporators 1 used for the experiment were identical in shape with the one shown in FIG. 1. They were 235 mm in height, 275 mm in left-to-right length and 48 mm in front-to-rear width. The aluminum intermediate plates 2 and aluminum flat plate 20 were each 0.5 mm in thickness. Each evaporator 1 had 21 pairs of intermediate plates 2 for providing flat tube portions 10*a*, 10*b*. The flat plate 20 having partition portions 21*a*, 21*b* was interposed between one pair of intermediate plates 2 providing flat tube portions 10*a*, 10*b* in the midportion of the evaporator 1. The flat tube portions 10*a*, 10*b* were 2.0 mm in channel height and 18 mm in channel width. The refrigerant holes 9*a*, 9*b* of the intermediate plates 2 and the refrigerant passing holes 22*a*, 22*b* of the flat plate 20 were 16 mm in diameter. The guide protuberances 23*a* in the form of a portion of a spherical surface and provided at the edges around the holes 22*a*, 22*b* of the flat plate 20 were also 16 mm in diameter like the holes 22*a*, 22*b*.

The evaporators 1 prepared were different in the angles of the guide protuberances 23*a*, 23*b* of the flat plate 20, and were actually used for motor vehicle air conditioners to check the evaporators 1 for cooling performance Q and channel resistance Pr.

Used as the reference for the evaluation of these properties were the cooling performance Q and channel resistance Pr of an evaporator wherein the guide protuberances 23*a*, 23*b* of the flat plate 20 had an angle of 0 deg, i.e., wherein the flat plate 20 had no guide protuberances 23*a*, 23*b*. The properties Q and Pr were expressed in percentages relative to the reference values which were taken as "100."

Used as the refrigerant was HFC134a, and the experiment was carried out by the method according to JIS D1618 (Method of Testing Motor Vehicle Air Conditioners).

Figure 13:
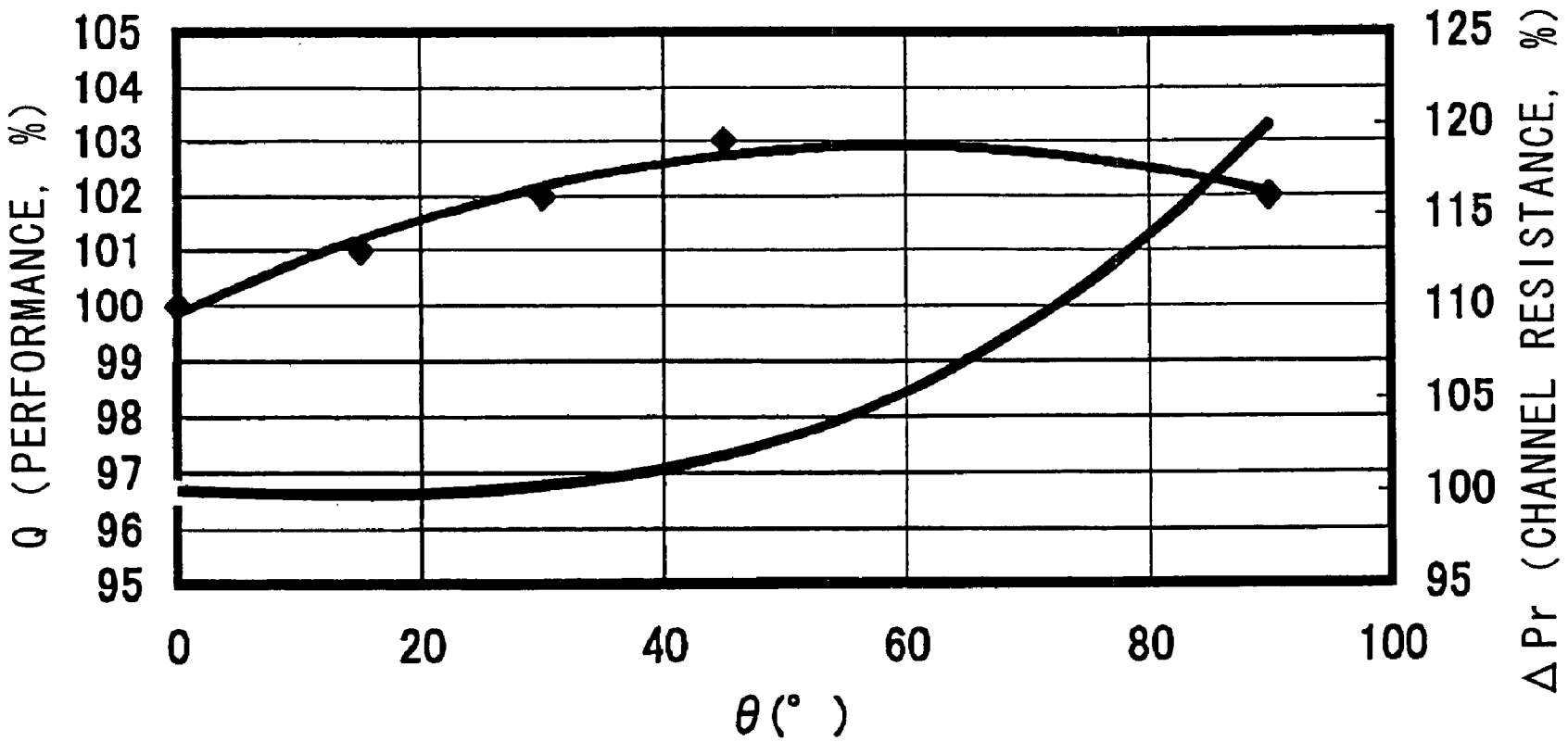
FIG. 13 is a graph showing the results obtained by a fundamental experiment.

Table 1 shows the results obtained, and FIG. 13 is a graph collectively showing the values of cooling performance Q and channel resistance Pr obtained by the evaporators 1.

TABLE 1

| (deg) | Q (Performance) | Pr (Channel resistance) |
|---|---|---|
| 0 | 100 | 100 |
| 15 | 101 | 100 |
| 30 | 102 | 100 |
| 45 | 103 | 102 |
| 90 | 102 | 120 |

The results given in Table 1 above and in the graph of FIG. 13 show that the angle of the guide protuberances 23*a*, 23*b* at the edges around the refrigerant passing holes 22*a*, 22*b* of the flat plate 20 should be in the range of 5 to 80 deg, and are preferably 10 to 70 deg, more preferably 15 to 60 deg, most preferably 15 to 45 deg.

Figure 7:
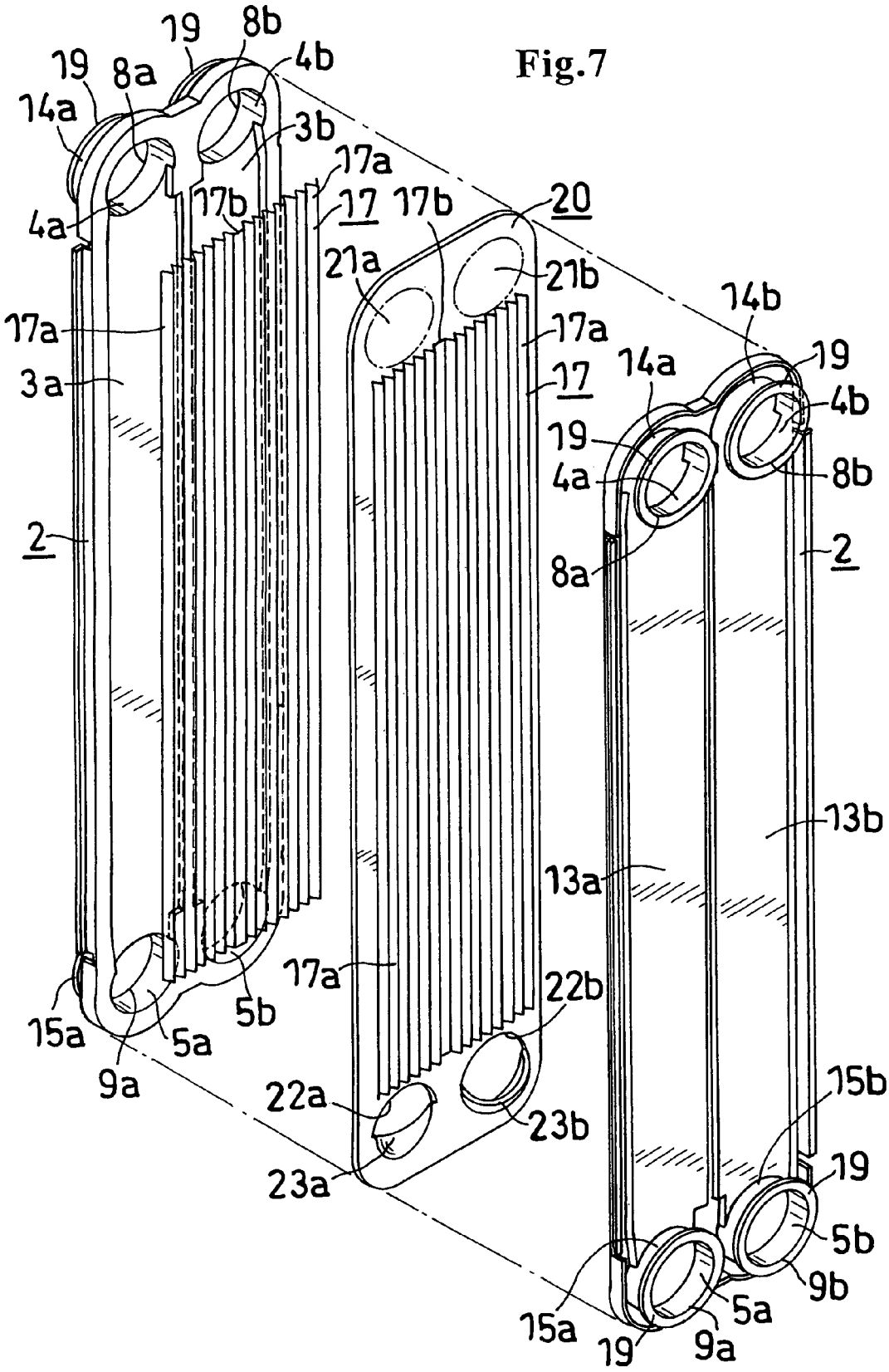
FIG. 7 shows a modified layered heat exchanger of the invention and is an enlarged exploded perspective view showing two intermediate metal plates and two inner fins providing flat tube portions, and a flat metal plate.

Next with reference to the modification of FIG. 7, the front and rear flat tube portions 10*a*, 10*b* of each flat tube may have enclosed therein an inner fin 17 comprising a corrugated aluminum plate. The inner fin 17 comprises corrugated portions 17*a*, 17*a* for providing front and rear divided refrigerant passageways and a central flat connecting portion 17*b*. The flat connecting portion 17*b* is joined to the central partition ridge 6 of the intermediate plate 2.

According to another modification (not shown), at the location where the flat plate 20 is installed in the evaporator 1 of FIG. 7, the above inner fin 17 is not provided, but the flat plate 20 itself may be provided on its opposite sides with corrugated portions for forming divided refrigerant passageways for the front and rear flat tube portions 10*a*, 10*b*, with a flat connecting portion formed on the flat plate 20 centrally thereof.

Figure 8:
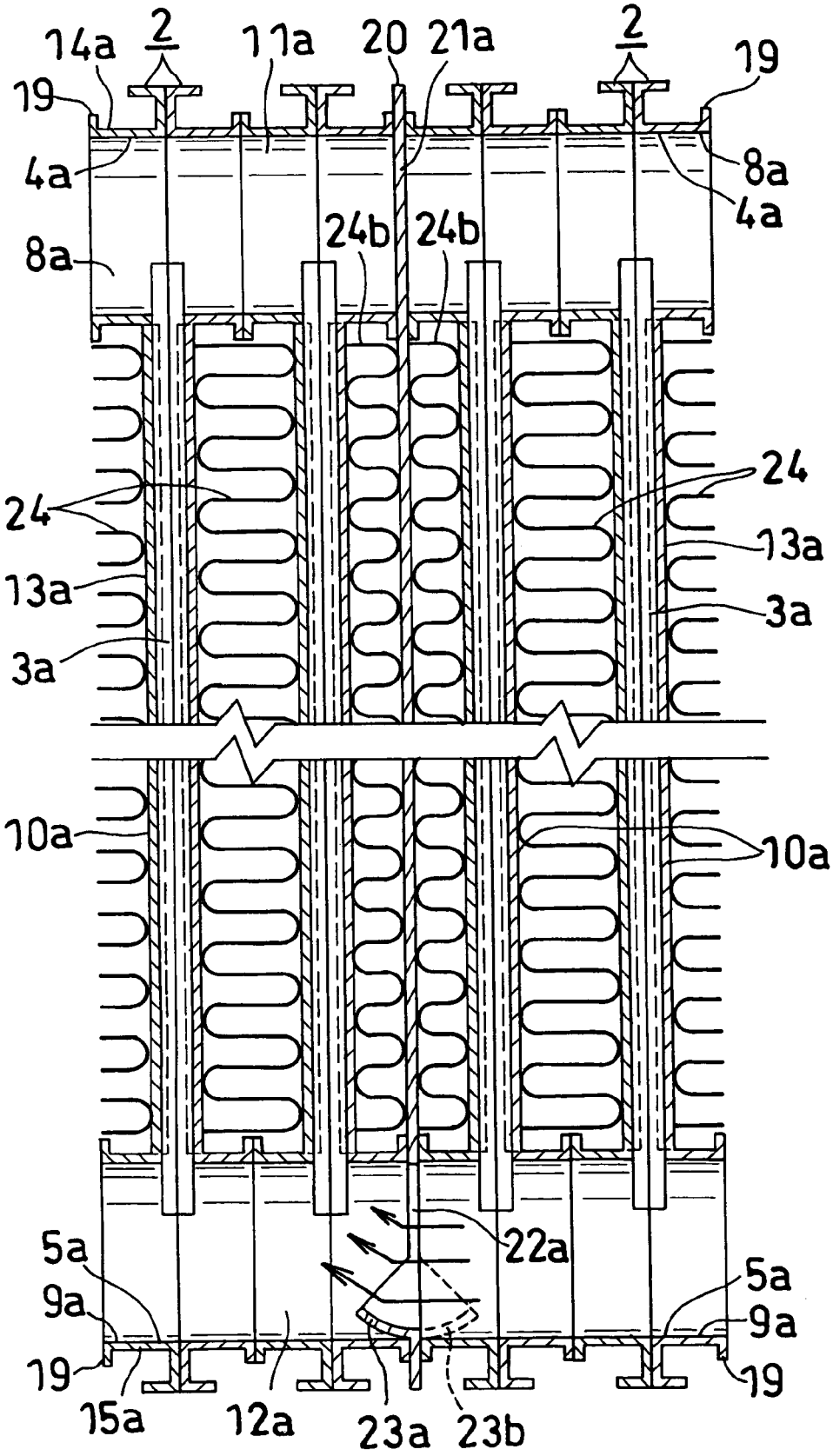
FIG. 8 is an enlarged fragmentary view in vertical section showing a layered heat exchanger of second embodiment of the invention.

FIG. 8 shows a second embodiment of the invention which differs from the first embodiment in that a flat plate 20 is interposed between the laterally adjacent flat tube portions 10*a*, 10*b* positioned at the midportion of the layered evaporator 1.

The flat plate 20 has partition portions 21*a*, 21*b* for blocking the passage of the refrigerant between the adjacent upper header portions 11*a*, 11*b* among the upper and lower header portions 11*a*, 11*b*, 12*a*, 12*b* in communication with the laterally adjacent flat tube portions 10*a*, 10*b*, and refrigerant passing holes 22*a*, 22*b* for permitting the passage of the refrigerant between the other header portions, i.e., the lower header portions 12*a*, 12*b* to form refrigerant channels through which the refrigerant flows zigzag through the entire assembly of all the flat tube portions 10*a*, 10*b* and upper and lower header portions 11*a*, 11*b*, 12*a*, 12*b*. While corrugated fins 24, 24 of usual height are provided between the adjacent flat tube portions 10*a*, 10*b*, a pair of divided corrugated fins 24*b*, 24*b* having about one-half of the height of the corrugated fins 24, 24 are provided on opposite sides of the flat plate 20.

The foregoing modifications and the second embodiment have the same construction as the first with the exception of the above features, so that throughout the drawings concerned, like parts are designated by like reference numerals or symbols.

Figure 9:
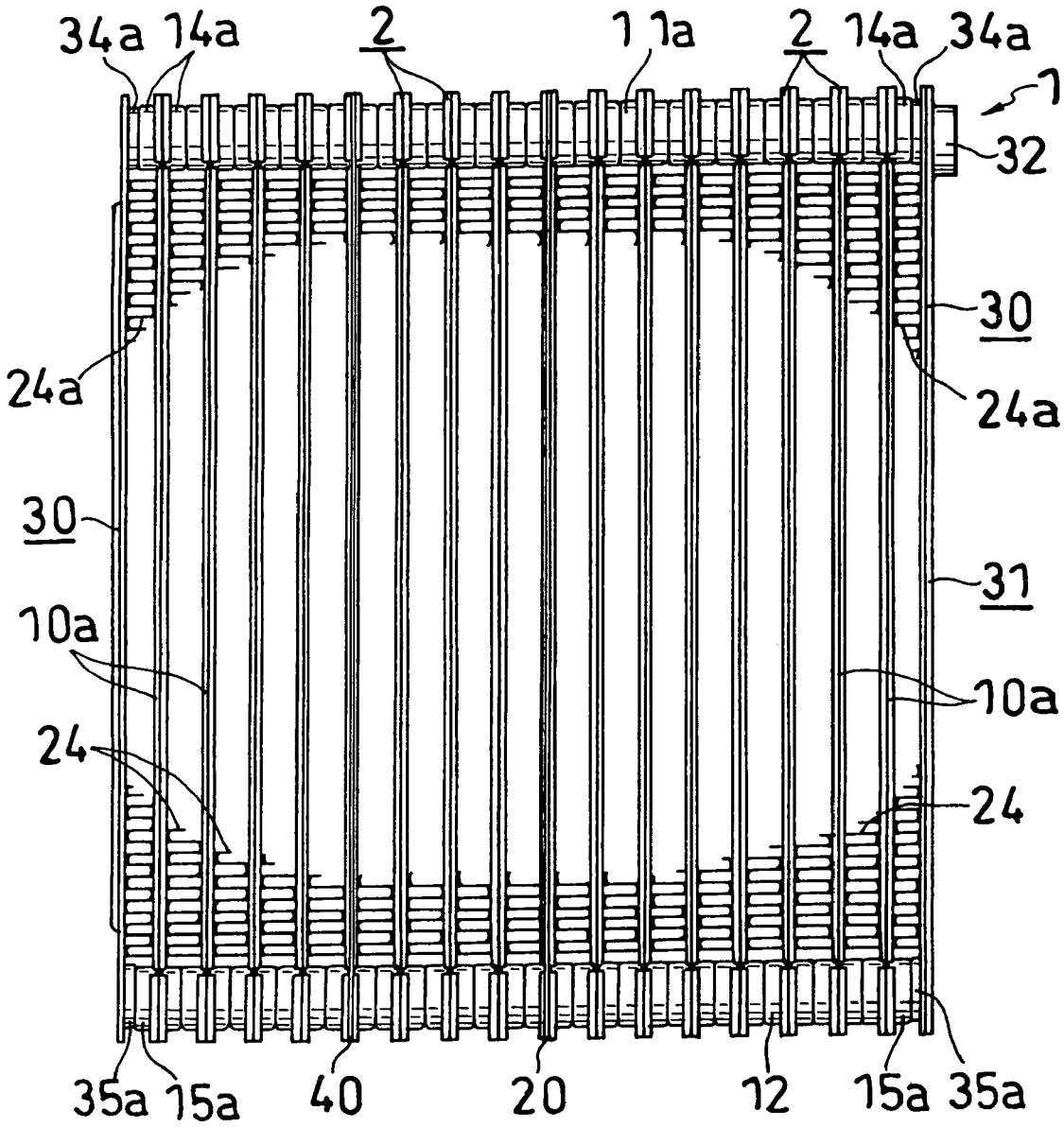
FIG. 9 is a front view schematically showing a layered heat exchanger of third embodiment of the invention.
Figure 10:
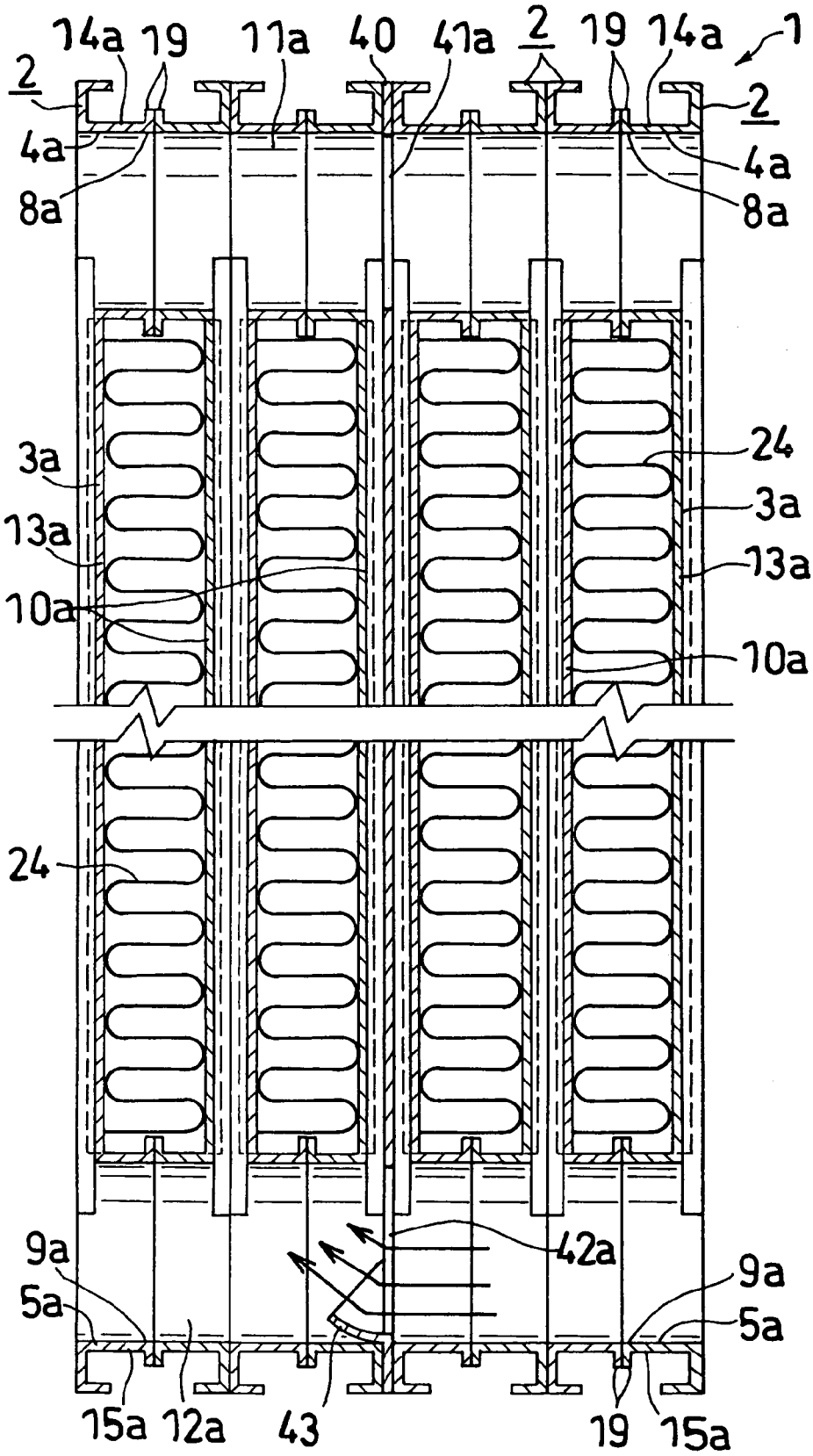
FIG. 10 is an enlarged fragmentary view in vertical section of the heat exchanger of FIG. 9.
Figure 11:
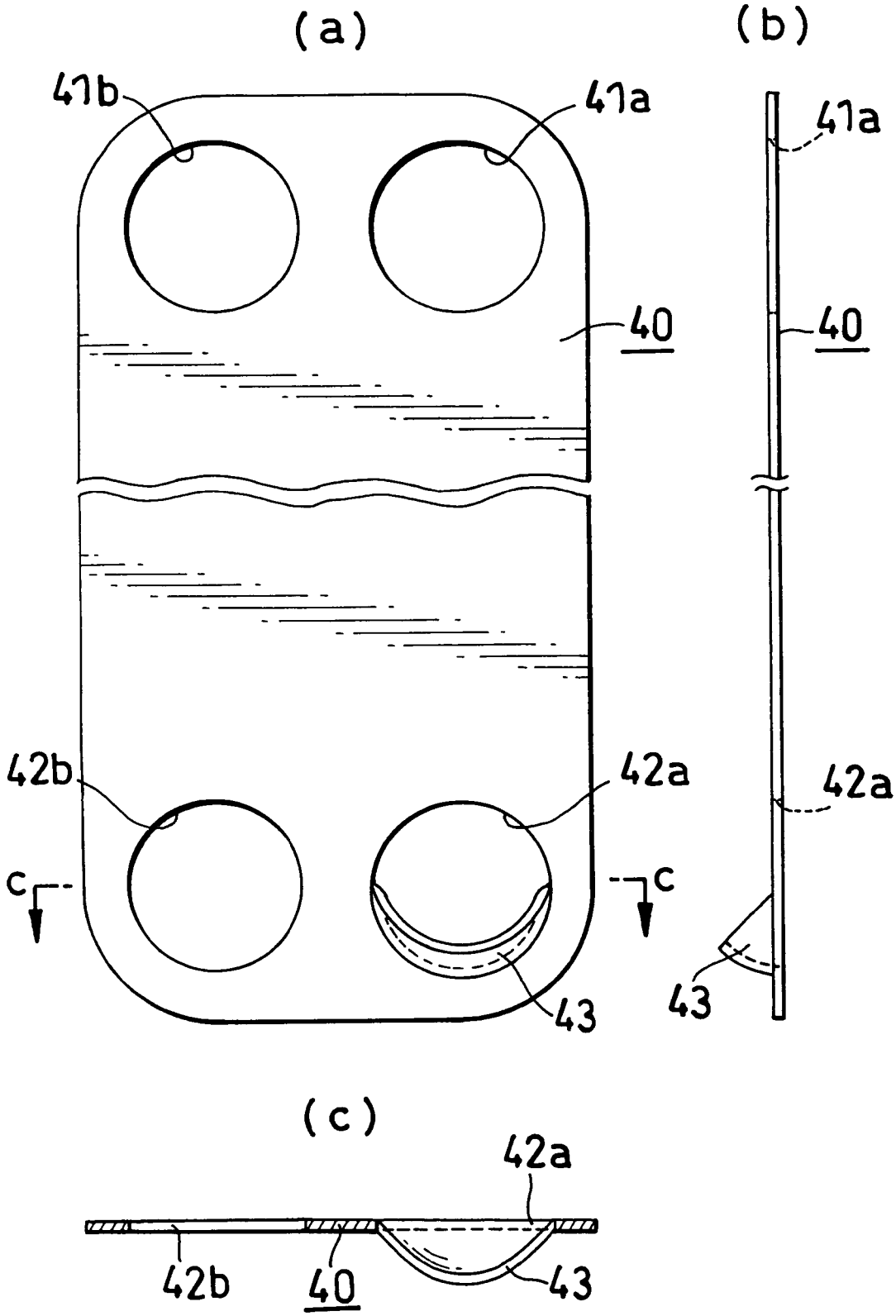
FIG. 11 shows an uneven flow preventing flat plate of FIG. 10, FIG. 11*a* being an enlarged front view partly broken away.

FIGS. 9 to 11 show a third embodiment of the invention, which differs from the first in that an uneven flow preventing flat plate 40 is interposed between one pair of intermediate metal plates 2 providing a flat tube 10 at an intermediate location at a distance corresponding to one quarter of the width of the evaporator 1 from the left end of the evaporator along the direction of juxtaposition of the intermediate plates. The flat plate 40 has refrigerant passing holes 41*a*, 41*b*, 42*a*, 42*b* for permitting the passage of the refrigerant through the upper and lower header portions 11*a*, 11*b*, 12*a*, 12*b* in communication with the flat tube 10, and a guide protuberance 43 formed at the edge around the refrigerant passing hole 42*a* at the lower-end front portion of the plate 40 for diffusing the refrigerant passing through the hole 42*a* into the front lower header 12*a*. Especially according to the present embodiment, the guide protuberance 43 is in the form of a portion of a spherical surface, has a substantially circular-arc form when seen from the front of the plate 40 and is inclined leftwardly upward, so that the refrigerant passing through the hole 42*a* of the plate 40 can be guided into the front flat tube portion 10*a* close to the hole 42*a*.

When the refrigerant flows from one pass to the next pass of the core of the evaporator 1 of this third embodiment, the uneven flow preventing guide protuberance 43 intentionally controls the flow of the refrigerant to preclude the occurrence of an uneven flow in the pass, permitting the refrigerant to flow in uniformly divided streams, giving a uniform temperature distribution to the air discharged through the core and ensuring improved performance.

Figure 12:
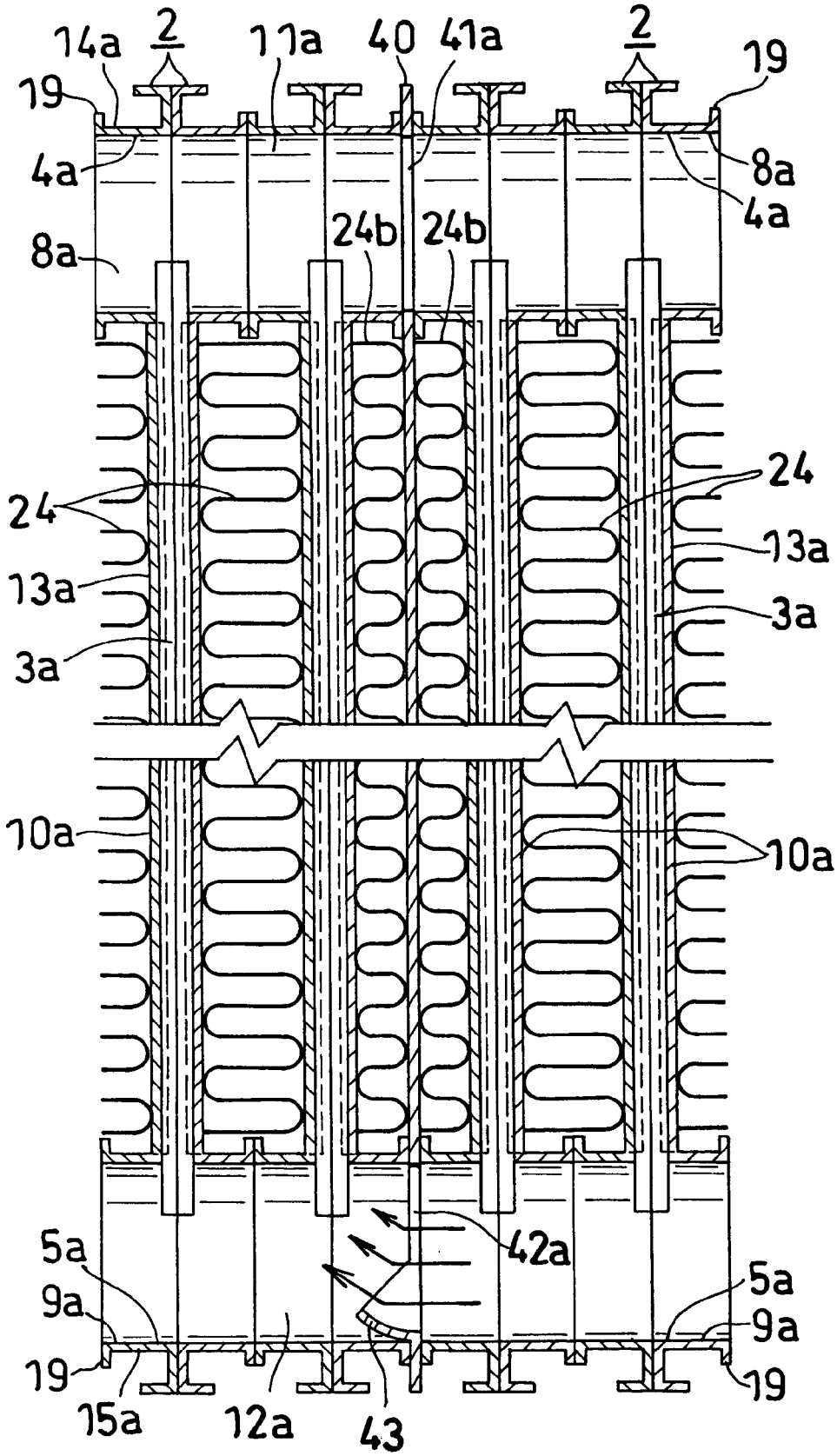
FIG. 12 is an enlarged fragmentary view in vertical section showing a layered heat exchanger of fourth embodiment of the invention.

FIG. 12 shows a fourth embodiment of the invention, which differs from the first in that an uneven flow preventing flat plate 40 is interposed between two flat tubes 10, 10 adjacent to each at an intermediate location at a distance corresponding to one quarter of the width of the evaporator 1 from the left end of the evaporator along the direction of juxtaposition of the intermediate plates. The plate 40 has refrigerant passing holes 41*a*, 41*b*. 42*a*, 42*b* for permitting the passage of the refrigerant through the upper and lower header portions 11*a*, 11*b*, 12*a*, 12*b* in communication with the adjacent flat tubes 10, and a guide protuberance 43 formed at the edge around the refrigerant passing hole 42*a* at the lower-end front portion of the plate 40 for diffusing the refrigerant passing through the hole 42*a* into the front lower header 12*a*. As is the case with the third embodiment, the guide protuberance 43 is in the form of a portion of a spherical surface, has a substantially circular-arc form when seen from the front of the plate 40 and is inclined leftwardly upward, so that the refrigerant passing through the hole 42*a* of the plate 40 can be guided into the front flat tube portion 10*a* close to the hole 42*a*.

Corrugated fins 24 are interposed between the flat tubes 10, 10 which are adjacent to one another, and a pair of divided corrugated fins 24*b*, 24*b* having about one-half of the height of the fins 24 are provided on opposite sides of the uneven flow preventing flat plate 40 interposed between the adjacent flat tubes 10, 10 at an intermediate location in the direction of juxtaposition of the intermediate plates.

When the refrigerant flows from one pass to the next pass of the core of the evaporator 1 of this fourth embodiment as in the case of the third embodiment, the uneven flow preventing guide protuberance 43 intentionally controls the flow of the refrigerant to preclude the occurrence of an uneven flow in the pass, permitting the refrigerant to flow in uniformly divided streams, thereby giving a uniform temperature distribution to the air discharged through the core and ensuring improved performance.

With the third and fourth embodiments, the guide protuberance 43 provided on the uneven flow preventing flat plate 40 intentionally controls the flow of refrigerant when the fluid flows to the next pass (group of flat tube portions through the refrigerant passing hole 42*a* in the flat plate 40 to thereby form uniformly divided streams of refrigerant and preclude occurrence of an uneven flow within the pass. Accordingly, the guide protuberance 43 is not limited to the illustrated one but can be modified variously in shape and inclination.

Further according to the third and fourth embodiments, the guide protuberance 43 is provided in the front lower header portion 12*a* and is therefore inclined leftwardly upward, whereas if the protuberance 43 is provided in the other header portions 11*a*, 11*b*, 12*b*, the protuberance is inclined leftwardly downward, rightwardly downward or rightwardly upward. Thus, the protuberance 43 can be modified variously in shape and inclination.

Although the flat plate 20 having the partition portions 21*a*, 21*b* and the uneven flow preventing flat plate 40 are used together in the third and fourth embodiments, only the uneven flow preventing plate 40 having the guide protuberance 43 may of course be used at an intermediate portion of the evaporator 1 along the direction of juxtaposition of intermediate plates.

The foregoing embodiments described are vertical layered evaporators wherein the flat tube portions 10*a*, 10*b* are arranged vertically in parallel, whereas the invention is similarly applicable to horizontal layered evaporators 1 wherein the flat tube portions 10*a*, 10*b* are arranged horizontally in parallel.

The present invention is useful not only for layered evaporators for motor vehicle air conditioners but also for other layered heat exchangers for use as oil coolers, aftercoolers, radiators, etc.

The invention claimed is:

1. A heat exchanger comprising flat tube portions arranged in parallel and at least one pair of upper and lower header portions communicating with the flat tube portion, the hear exchanger characterized in that an edge portion around a fluid passing hole for permitting inflow of fluid into the header portion wherein the fluid flows in a direction perpendicular to the lengthwise direction of the flat tube portion is provided with a guide protuberance for diffusing the fluid flowing through the fluid passing hole into the header, and that the guide protuberance is so shaped as to resemble a portion of a spherical surface and has an approximately circular-arc shape.

2. A heat exchanger according to claim 1, wherein the guide protuberance is configured to guide the fluid flowing through the fluid passing hole to the flat tube portion in a vicinity of the fluid passing hole.

3. A heat exchanger according to claim 1, wherein the guide protuberance is inclined leftwardly upward and rightwardly upward when seen from front.

4. A heat exchanger according to claim 1, wherein an angle θ of the guide protuberance is 5 to 80 deg.

5. A heat exchanger according to claim 4, wherein the angle θ of the guide protuberance is 10 to 70 deg.

6. A heat exchanger according to claim 4, wherein the angle θ of the guide protuberance is 15 to 60 deg.

7. A heat exchanger according to claim 4, wherein the angle θ of the guide protuberance is 15 to 45 deg.

8. A heat exchanger according to claim 2, wherein the guide protuberance is inclined leftwardly upward and rightwardly upward when seen from front.

9. A heat exchanger according to claim 2, wherein an angle θ of the guide protuberance is 5 to 80 deg.

10. A heat exchanger according to claim 3, wherein an angle θ of the guide protuberance is 5 to 80 deg.

11. A heat exchanger according to claim 8, wherein an angle θ of the guide protuberance is 5 to 80 deg.

12. A heat exchanger comprising:

flat tube portions arranged in parallel with each other;

upper and lower header portions communicating with the flat tube portions;

a plate provided between the flat tube portions and having a fluid passing hole around which an edge portion is provided and into which the fluid flows in a direction substantially perpendicular to a longitudinal direction of the flat tube portions; and a guide protuberance provided at the edge portion for diffusing the fluid flowing through the fluid passing hole into at least one of the upper and lower header portions, the guide protuberance being so shaped as to resemble a portion of a spherical surface and has an approximately circular-arc shape.

* * * * *